United States Patent [19]

Cunningham

[11] Patent Number: 4,976,483

[45] Date of Patent: Dec. 11, 1990

[54] STAKE DRIVING TOOL

[76] Inventor: Isaiah V. Cunningham, 431 McKinley Ave., Charleston, W. Va. 25314

[21] Appl. No.: 357,927

[22] Filed: May 30, 1989

[51] Int. Cl.[5] ..... B66C 1/22

[52] U.S. Cl. ..... 294/92; 254/29 R

[58] Field of Search ..... 294/92, 60; 254/18, 254/22, 29 R, 131, 133 R, 1; 135/118; 24/129 A, 129 B, 130, 115 H

[56] References Cited

U.S. PATENT DOCUMENTS

| | | | |
|---|---|---|---|
| 992,070 | 5/1911 | Schopf | 294/92 |
| 1,086,813 | 2/1914 | Fritts | 248/316.3 |
| 2,997,327 | 8/1961 | Bjalme | 294/92 |
| 3,125,907 | 3/1964 | Derrickson | 254/133 R X |
| 3,965,720 | 6/1976 | Goodwin et al. | 254/131 X |
| 4,040,601 | 8/1977 | Boardman | 294/92 X |

FOREIGN PATENT DOCUMENTS

| | | | |
|---|---|---|---|
| 981186 | 12/1982 | U.S.S.R. | 294/92 |

*Primary Examiner*—Margaret A. Focarino
*Assistant Examiner*—Dean J. Kramer
*Attorney, Agent, or Firm*—Sughrue, Mion, Zinn, Macpeak & Seas

[57] ABSTRACT

The stake driving tool is comprised of an angled plate having first and second identical portions each of which is provided with a laterally extending slot. A stake to be driven into the ground is inserted into a slot in one of the portions with the edges of the slot frictionally gripping the stake whereby the other portion will extend outwardly from the stake for engagement by foot pressure to drive the stake into the ground.

1 Claim, 1 Drawing Sheet

STAKE DRIVING TOOL

BACKGROUND OF THE INVENTION

The present invention is directed to a stake driving tool and more specifically to an angled plate having a first portion with a slot for frictionally gripping a stake and a second portion for the application of foot pressure to drive the stake into the ground.

The broad concept of frictionally engaging a plate with an elongated rod-like member by extending the rod through an opening in the plate and canting the plate relative to the axis of the rod to frictionally engage the edges of the opening with the rod is old and well known in the art. An example of a device embodying this concept is disclosed in the U.S. Pat. No. 1,086,813 to Fritts wherein a rod is held in an elevated position by engagement with the edges of an angled slot in a pivoted plate member. Upon pivotal movement of the plate member to dispose the slot vertically the rod will be released from engagement with the plate. Variations of this concept are disclosed in the Lundgren et al. U.S. Pat. No. 2,776,726, Hansen U.S. Pat. No. 3,264,026, Wesemann U.S. Pat. No. 3,363,927 and Boardman U.S. Pat. No. 4,040,601.

SUMMARY OF THE INVENTION

The present invention is directed to a device for driving stakes into the ground in a quick and efficient manner with a minimum amount of physical exertion.

The present invention provides a new and improved device for driving stakes into the ground comprising an angled plate member having a first portion with a laterally extending slot for the reception of an elongated rod and a second portion adapted to be subjected to foot pressure to pivot the plate into frictional engagement with the rod and force the rod downwardly into the ground.

The foregoing and other objects, features and advantages of the invention will be apparent from the following more particular description of a preferred embodiment of the invention as illustrated in the accompanying drawings.

Brief Description of the Drawinqs

DETAILED DESCRIPTION OF THE INVENTION

Figure 1:
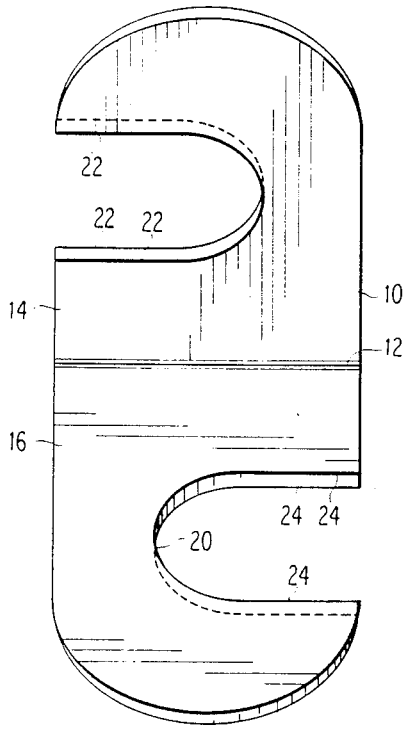
FIG. 1 is a front perspective view of the tool according to the present invention.
Figure 2:
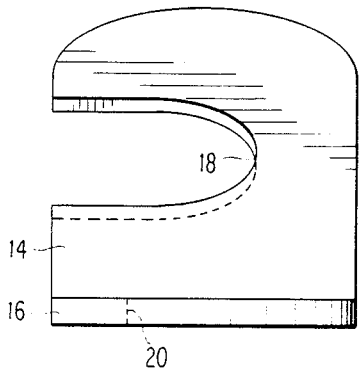
FIG. 2 is a front elevational view of the tool according to the present invention.

The stake driving device according to the present invention is comprised of an elongated substantially rectangular steel plate 10 which is bent along a middle line 12 to define two identical portions 14 and 16. Each portion has an elongated laterally extending slot 18 and 20, respectively, formed therein. Since the plate 10 is a steel plate the slots may be cut into each portion of the plate by a cutting torch so that the edges 22 and 24 of the slots 18 and 20 are relatively sharp to assist in gripping a stake.

The slots 18 and 20 extend into the respective portions 14 and 16 of the plate on opposite sides to facilitate handling of the tool under different operational circumstances. Two slots have been provided for the sake of versatility but it is only necessary to have a single slot in one of the portions of the plate while the other portion which is adapted to be engaged by foot pressure can be without a slot. The width of one slot may be greater than the width of the other slot to accommodate different size stakes.

Figure 3:
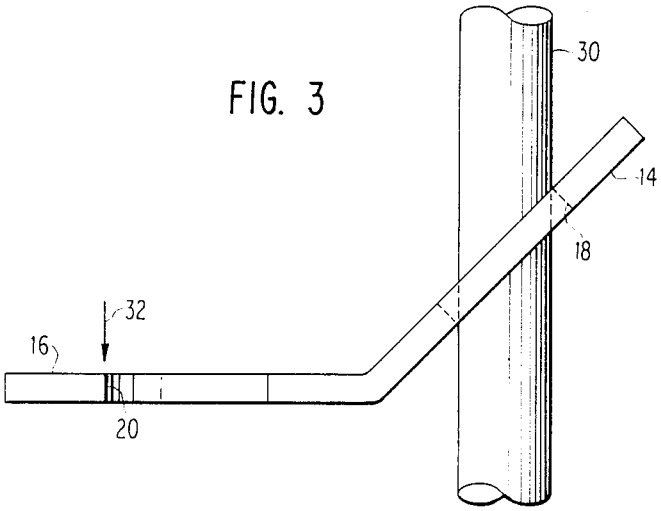
FIG. 3 is a side elevational view of the device in operative engagement with a stake to be driven into the ground.

While it is preferable that the plate be made of steel so as to resist bending during the driving operation it is conceivable that various other materials could be used in the formation of the tool provided there is sufficient strength to prevent bending of the plate during operation. In the device illustrated, the angle between the two portions 14 and 16 is approximately 130° .However, this angle can be varied considerably in either direction between 90° and 180° . The ideal angle is primarily determined by the thickness of the stake or rod 30 which is adapted to be driven by the tool as shown in FIG. 3. It is preferable that the angle be such that when the edges of the slot 18 frictionally grip the rod or stake 30 the foot engaging portion 16 will be disposed substantially perpendicular to the axis of the stake or rod 30 so that foot pressure can be applied more efficiently in a vertical downward direction as indicated by the arrow 32.

In operation of the tool, it is only necessary to place the rod or stake in a vertical position and place the tool on the stake with the rod extending through the slot. If it is desired to drive the stake approximately 18 inches into the ground the tool would be placed on the stake about 18 inches from the bottom end of the stake. Upon releasing the tool, the weight of the tool will cause the portion of the plate with the slot receiving the stake to tilt and frictionally hold the tool in the desired position. When the stake is located in the correct position it is only necessary to apply foot pressure on the other portion of the plate to drive the stake into the ground until the plate contacts the ground.

While the invention has been particularly shown and described with reference to a preferred embodiment thereof it will be understood by those in the art that various changes in form and details may be made therein without departing from the spirit and scope of the invention.

What is claimed is:

1. A stake driving tool comprising a plate having first and second planar portions each disposed in adjacent planes at an angle of approximately 130° relative to each other about a transverse line, a laterally extending slot disposed in one of said planar portions substantially parallel to said line and a second laterally extending slot disposed in said other planar portion substantially parallel to said line wherein said slots extend into said plate from opposite directions, each of said slots having substantially opposed edges spaced apart a distance substantially greater than the width of a stake to be driven into the ground and adapted to frictionally engage opposite sides of said stake when said stake extends vertically through said slot with the other portion of said plate extending substantially horizontally outwardly from said stake for downward engagement by foot pressure to drive said stake into the ground.

* * * * *